US005238146A

United States Patent [19]

Thorne, Jr.

[11] Patent Number: 5,238,146

[45] Date of Patent: Aug. 24, 1993

[54] SUPPORT DEVICE TO FACILITATE EMPTYING OF CONTAINERS

[75] Inventor: John F. Thorne, Jr., Glen Ellyn, Ill.

[73] Assignee: Van Leer Containers, Inc., Chicago, Ill.

[21] Appl. No.: 837,077

[22] Filed: Feb. 18, 1992

[51] Int. Cl.[5] ..... B67D 5/06

[52] U.S. Cl. ..... 222/1; 222/173; 222/185; 222/382; 248/133; 248/146

[58] Field of Search ..... 222/1, 173, 184, 185, 222/372, 377, 382, 383, 385, 464; 248/133, 146

[56] References Cited

U.S. PATENT DOCUMENTS

| | | | |
|---|---|---|---|
| 374,232 | 12/1887 | Babcock | 222/173 |
| 758,866 | 5/1904 | Sherwood | 248/133 |
| 1,530,074 | 3/1925 | Eckert | 222/382 X |
| 1,803,797 | 5/1931 | Gerhardt | 248/133 |
| 2,321,836 | 6/1943 | Marzo | 222/173 X |
| 2,366,529 | 1/1945 | Hoff | 222/173 X |
| 2,466,323 | 4/1949 | Meyer | 248/146 X |
| 2,549,207 | 4/1951 | Kestenbaum | 222/185 X |
| 2,785,836 | 3/1957 | Smith et al. | 222/184 X |
| 3,035,737 | 5/1962 | Speas | 222/382 X |
| 3,279,619 | 10/1966 | Alissandratos | 248/146 X |
| 3,814,293 | 6/1974 | Daves | 222/173 |
| 3,819,138 | 6/1974 | Rehkopf et al. | 248/146 |
| 4,114,782 | 9/1978 | Berry | 222/382 |
| 4,515,334 | 5/1985 | Horne | 248/146 |
| 4,722,463 | 2/1988 | Anderson | 222/185 |
| 4,928,860 | 5/1990 | Thorne, Jr. | 222/184 X |
| 4,972,973 | 11/1990 | Davis | 222/377 X |

OTHER PUBLICATIONS

Valcline Brochure, "Introducing Valcline," Van Leer Packaging Worldwide.

*Primary Examiner*—Kevin P. Shaver

*Attorney, Agent, or Firm*—Fitch, Even, Tabin & Flannery

[57] ABSTRACT

A support device for insertion beneath a portion of one end of a drum, configured for stable engagement with a chime or a groove so that the drum may be reliably and securely supported in a tilted position for an extended period of time to facilitate emptying of residue therefrom. The device preferably has a generally wedge-shaped configuration with an upper surface which slopes downward from back to front The device may have a curved channel to receive a drum chime, and/or one or more ears for insertion in a peripheral end-wall groove. The device may be employed to facilitate either pumping of residue with the drum in an upright position, or draining of the residue through an opening in the lid by inverting the drum. In the latter case, to facilitate proper placement of drums of the type having a pair of spouts at diametrically opposed locations on the lid, an opening is provided in the upper wall of the device to accommodate one of the spouts. The device may also be equipped with stabilizing protrusions on its back wall so that it is capable of use in a position in which the back wall serves as the base, with the forward end of the device inserted in an end-wall groove on the drum.

16 Claims, 4 Drawing Sheets

SUPPORT DEVICE TO FACILITATE EMPTYING OF CONTAINERS

BACKGROUND OF THE INVENTION

The invention relates generally to handling of large containers such as drums, and, more particularly, to a support device to facilitate emptying of residue from such containers.

Large steel and plastic drums are used throughout the world for storage, shipment and dispensing of various fuels, lubricants, solvents, and other industrial and agricultural chemicals. In the United States, 55 gallon steel drums have been commonly used for many years for such purposes Pumps are typically employed to remove the contents. In the past, in removing liquids from such drums in industrial applications, it was common to leave a residue of about two liters in the containers, due primarily to limitations of the pumping equipment typically employed for dispensing the liquid contents The drums would then often be discarded with little regard for the ultimate disposition of the residue.

Recently, government regulations and public awareness of the potential environmental impact of various substances have led to interest in tighter control over disposal of residual amounts of substances left in such drums after the bulk of the substance has been dispensed. Economic considerations are also served by minimizing waste of residual amounts of material which remain in the drum after use of the bulk of the material.

Pumps in use today are generally capable of removing a greater percentage of the drum contents than the older pumps mentioned above, but still typically leave a residue of some 200 to 300 milliliters of fluid in the drum. Removing the residues is a time consuming and expensive problem for the drum reconditioning industry. If fluid residues are not removed promptly after usage of the bulk of the drum contents, the problem may be compounded by liquids which thicken or dry over time due to evaporation of volatile components or other factors, requiring the use of chemical solvents, burning, or other difficult and expensive steps to clean the drum.

Common configurations of drum lids (heads) include the "standard" lid wherein the lid is generally convex; and configurations wherein the lid is generally concave, such that its lowest point is at its center. In both, a spout (flanged opening) is typically located adjacent the periphery of the lid. In some drum lids, two spouts are provided, 180° apart from one another, adjacent the periphery of the lid. The drum lid is typically joined to the upper edge of the cylindrical drum sidewall by an annular projecting chime. The bottom wall is similarly joined to the lower edge of the sidewall.

Polyethylene drums differ slightly from steel drums with respect to the configurations of the peripheral areas of the lids. Rather than a chime as described above with respect to the steel drums, the typical polyethylene drum has a handling ring with a relatively deep groove defined by the interior of the handling ring and the exterior of the lid surface directly inward of the handling ring. The exterior surface of the lid has a generally horizontal central portion and a frustoconical portion extending outward therefrom to the base of the handling ring.

It has been found that removal of much of the residual liquid from a drum can be accomplished by inverting the drum and maintaining it at an inclination of 5° to 10°, with the spout, or one of the spouts, at the lowest point. One specifically designed commercially available racking system, known as the Valcline racking system, provides means to support a row of several drums side-by-side in inverted position at the desired inclination, elevated a few inches from a supporting surface. The drums must be lifted onto the rack, and left on the rack for a period dependent on the viscosity of the liquid being drained from the drum. A locating pin facilitates placement of the spout over a receptacle for collection of residual contents.

This racking system has been found to provide a relatively convenient means for facilitating drainage of residual liquids. However, there is a need for means to enable emptying of residue from large drums and the like in a safe, efficient, and economical manner in commercial and industrial applications where known commercial rack systems may be less than ideal due to space constraints, cost, or other considerations.

SUMMARY OF THE INVENTION

In accordance with the invention, there is provided a support device which is configured for stable engagement with a chime or a groove at one end of a drum so that emptying of residue from the drum may be facilitated by insertion of the device beneath a portion of one end of the drum.

The device preferably has a generally low wedge-shaped configuration with an upper surface which slopes downward from back to front. In one preferred embodiment, the device has a curved channel to receive the chime of a standard 55 gallon steel drum. The channel for receiving the chime comprises a substantially horizontal bottom wall with opposed inner and outer walls extending upward therefrom. The outer wall is preferably slightly higher than the inner wall to facilitate insertion of the device to the proper radial position relative to the drum.

In another embodiment, the device has one or more ears configured for insertion in a peripheral end-wall groove of a drum. To facilitate proper placement of drums of the type having a pair of spouts at diametrically opposed locations on the lid, an opening is provided in the upper wall of the device to accommodate one of the spouts.

In accordance with a further aspect of the invention, the device may be equipped with stabilizing protrusions on its back wall or designed with a flat or stable back configuration so that it is capable of use in a second position in which it is rotated back 90° from its normal use position, with the forward end of the device inserted in an end-wall groove to provide greater elevation of one side of the drum.

DETAILED DESCRIPTION OF THE PREFERRED EMBODIMENT

The invention is preferably embodied in a support device to facilitate emptying of residual contents of large drums, and in a method of using the support device.

Figure 1:
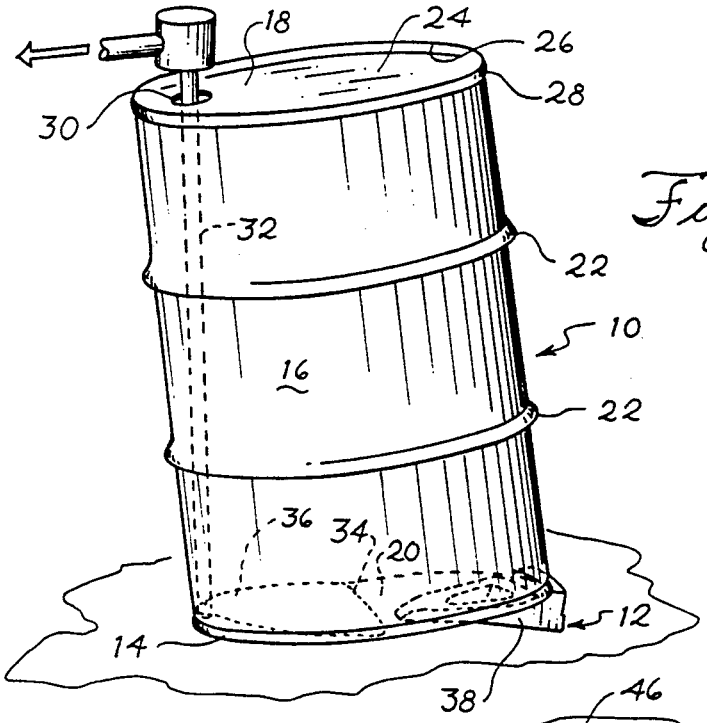
FIG. 1 is a perspective view illustrating a support device in accordance with a first embodiment of the invention, in use in a first application.

Referring to FIG. 1, there is shown a 55 gallon steel drum 10 with a support device 12 in accordance with a first embodiment of the invention inserted under a portion of the bottom chime 14 of the drum 10 to maintain the drum in an inclined position. The drum comprises a generally cylindrical sidewall 16 and top and bottom end walls 18 and 20. The sidewall 16 has ribs 22 formed therein for reinforcement. The top wall has a generally convex central portion 24 surrounded by an inwardly facing annular surface 26, which extends upward to a generally toroidal chime 28 which joins the periphery of the end wall to the upper edge of the sidewall. The top wall is shown with a single spout 30 therein, through which is inserted a pump intake lance having an opening at its lower end for intake of fluid from the drum.

The bottom wall 20 is similar to the top wall and has a generally convex central portion 34 surrounded by an annular, generally vertical wall 35 extending downward to the generally toroidal chime 14. However, the bottom wall does not have a spout or other opening formed therein.

Figure 12:
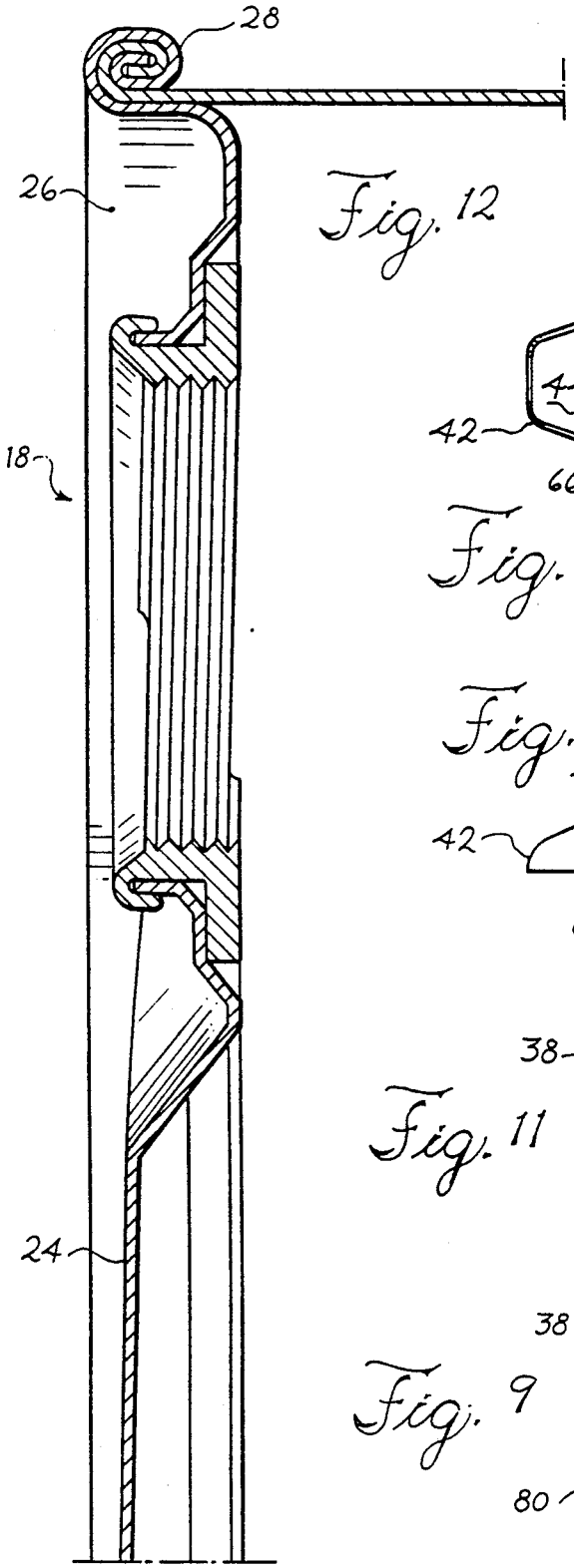
FIG. 12 is a detailed sectional view illustrating a steel drum spout and chime in section

The drum end walls and sidewall are made of sheet metal. The chimes are formed by rolling the edges of the end wall and the sidewall along the exterior of the drum sidewall, as shown in FIG. 12.

For purposes of example, the drum 10 may be a 22½-inch diameter closed-head round-seam drum, in which the convexity of each end wall is about one-half inch chime 28 to the point at which the annular surface 26 joins the central portion is about ⅝-inch, with the bottom wall being similarly dimensioned.

In accordance with the invention, the device is configured to stably support the drum 10 at an optimal inclination to facilitate emptying of residue 36 therefrom. In the illustrated embodiment, this angle is in the range of about 5° to 15°, and is preferably about 10°.

The device 12 is preferably made of a suitable polymeric material such as high density polyethylene (HDPE) which enables economical mass production by injection molding while providing the requisite strength, durability, and impact resistance with relatively light weight.

The device 12 is preferably of generally wedge-shaped configuration, having generally triangular, substantially planar sidewalls 38, a back wall 40 convexly curved about a substantially vertical axis, and a front wall 42 which is convexly curved about a horizontal axis to blend with a sloping top wall 44. The sidewalls 38 of the device converge from back to front. The top wall 44 slopes upward from front to back to a horizontal channel 46 which is configured to receive the drum chime. Behind the channel, the top wall extends generally horizontally to intersect the upper edge of the back wall.

The channel 46 comprises a bottom wall 48 and opposite front and back walls 50 and 52 extending upward therefrom. The front or inner wall 50 of the channel is curved about a substantially vertical axis at a radius corresponding to the radius of curvature of the inner surface of the chime. The outer or back wall 52 of the channel is curved at a radius of curvature corresponding to that of the outer surface of the chime. The front and back walls of the channel are spaced from one another by a distance slightly greater than the radial dimension, or thickness, of the chime so that a large variety of chime or handling ring configurations may be accommodated. The back wall of the channel has a greater vertical dimension than the front wall. This facilitates proper placement of the device with respect to the chime.

To insert the device in place, the user raises one side of the drum 10, opposite the pump lance 32, and inserts the front end of the device 12 underneath the raised portion of the drum. The user then may push the device forward. The top wall may engage the chime as the device is pushed forward until the device has been pushed inward to the point where the chime 14 aligns with the channel 46, at which point the chime drops into the channel. The relatively high back wall 40 of the channel aids in preventing the device from being inserted too far radially inward The device 12 has an opening 54 in the top wall to accommodate a spout. This is useful where the drum is of the type having a pair of spouts at diametrically opposed locations on the lid, and it is desired to drain residue from the drum through one of the spouts by inverting the drum. The other spout may then be located in the opening 54 in the top wall of the device to insure that the spout through which the residue is to be drained is properly located at the lowest point.

Figure 4:
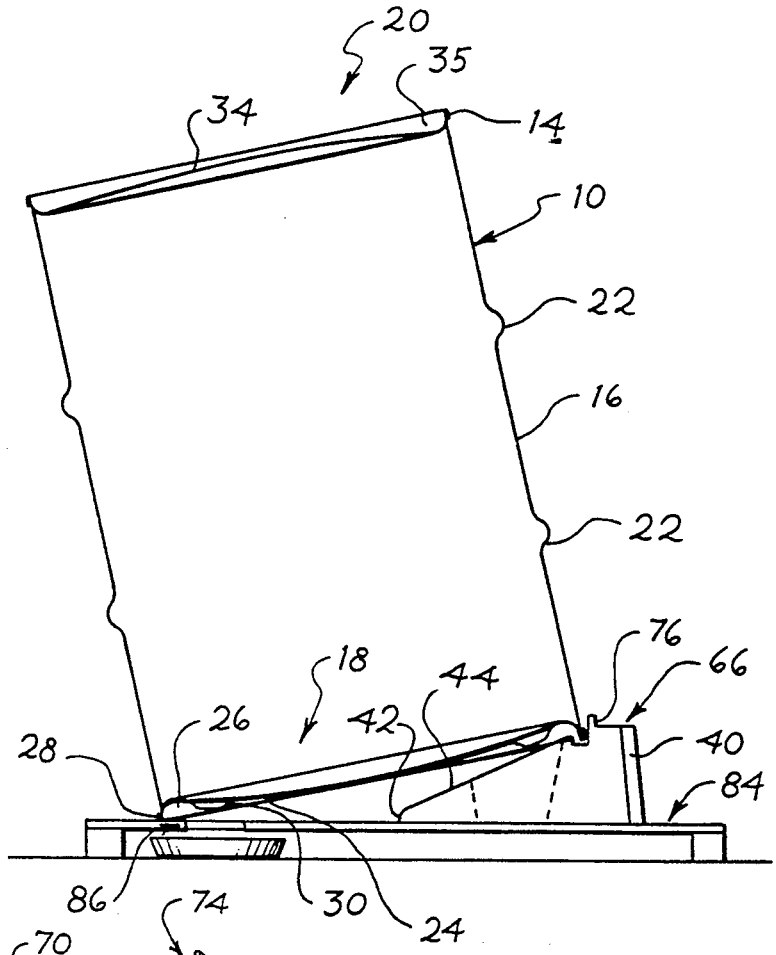
FIG. 4 is a schematic side elevational view of a support device in accordance with a second embodiment of the invention, in use in a second application.

FIG. 4 illustrates a drum being emptied in this manner in conjunction with a device 66 in accordance with a second embodiment of the invention, as described in greater detail below.

Extending downward from the edges of the opening in the top wall are a pair of sidewalls 56 and 58, a front wall 60, and a back wall 62. The bottom edges of the walls depending about the edges of the opening are substantially coplanar with the bottom edges of the sidewalls, front wall, and back wall of the device to provide a stable base for the device.

Figure 2:
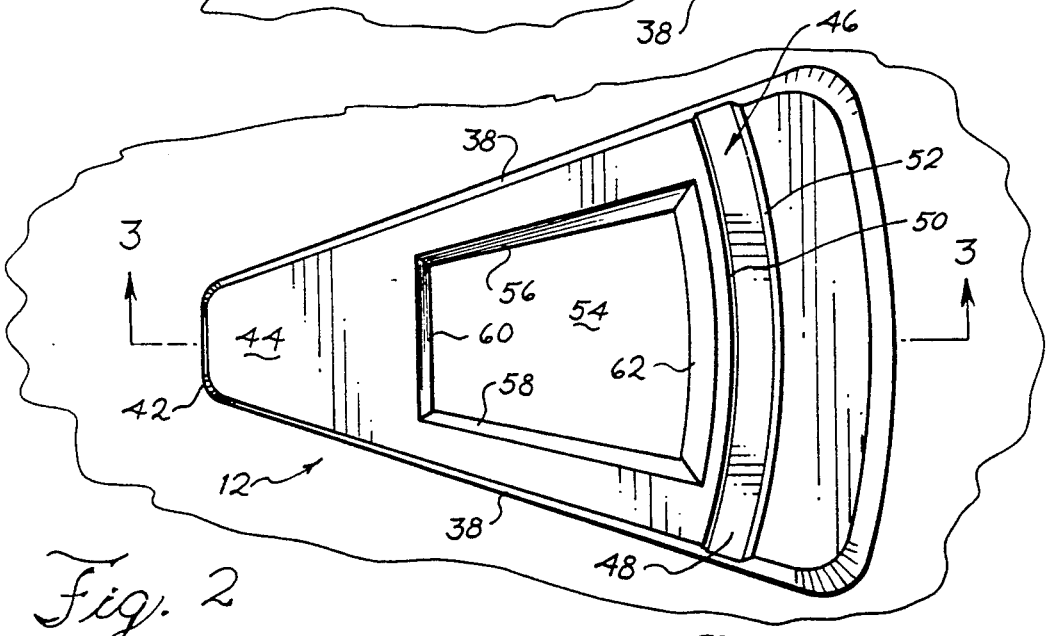
FIG. 2 is a plan view of the support device of FIG. 1, shown on an enlarged scale.
Figure 3:
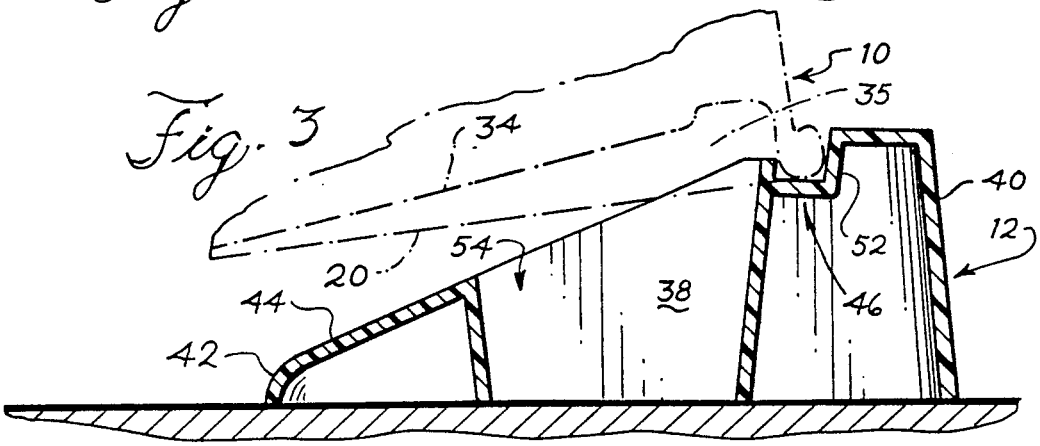
FIG. 3 is a sectional view taken substantially along line 3—3 in FIG. 2.

As best seen in the plan view of FIG. 2, the back wall, front wall, and sidewalls of the device slope slightly inward from bottom to top, whereas the walls depending from the edges of the opening slope slightly outward from top to bottom. This configuration facilitates injection molding of the device, as well as enhancing stability of the device and its ability to resist tipping over. This slope also allows partial nesting for warehouse and freight savings and the inner walls of the spout opening provide added support to the chime channel.

A device 66 in accordance with a second embodiment of the invention is illustrated in FIGS. 4–11.

In FIG. 4, the device 66 is shown in use for draining an inverted drum in the manner mentioned above. The drum and device are supported on a platform 84 with an opening 86 therein beneath one spout, the other spout being disposed in an opening in the top wall of the device. A receptacle is positioned beneath the opening 86.

Figure 5:
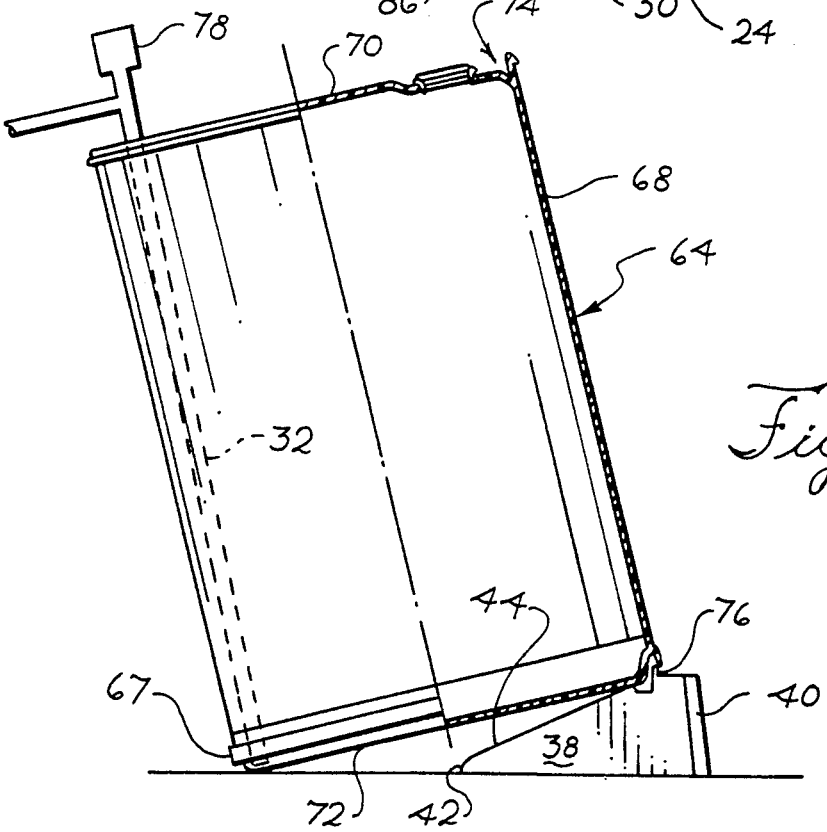
FIG. 5 is a schematic elevational view illustrating the support device of FIG. 4 in use in a third application.

The device 66 is provided with features to enable it to be usable not only with a standard steel drum having a chime as described above, but also with a commercially available drum of the type illustrated at 64 in, e.g., FIG. 5. This type of drum, which is typically made of polyethylene, has a bottom handling ring 67, and a somewhat different configuration than the steel drum 10. The device 66 is substantially similar to the first embodiment 12 described above with respect to components identified by like reference numerals The drum 64 has a sidewall 68 and top and bottom end walls 70 and 72, each having a peripheral groove 74 therein. The device for use with this type of drum has a pair of ears 76 disposed coincident with the back wall of the channel 46, the ears 76 being configured for insertion into the groove 74. This enables the device to be used generally in the manner described above with reference to the first embodiment, except for engagement of the ears 76 in the groove 74, rather than insertion of a chime in the channel 46 as in the case of a steel drum.

Figure 6:
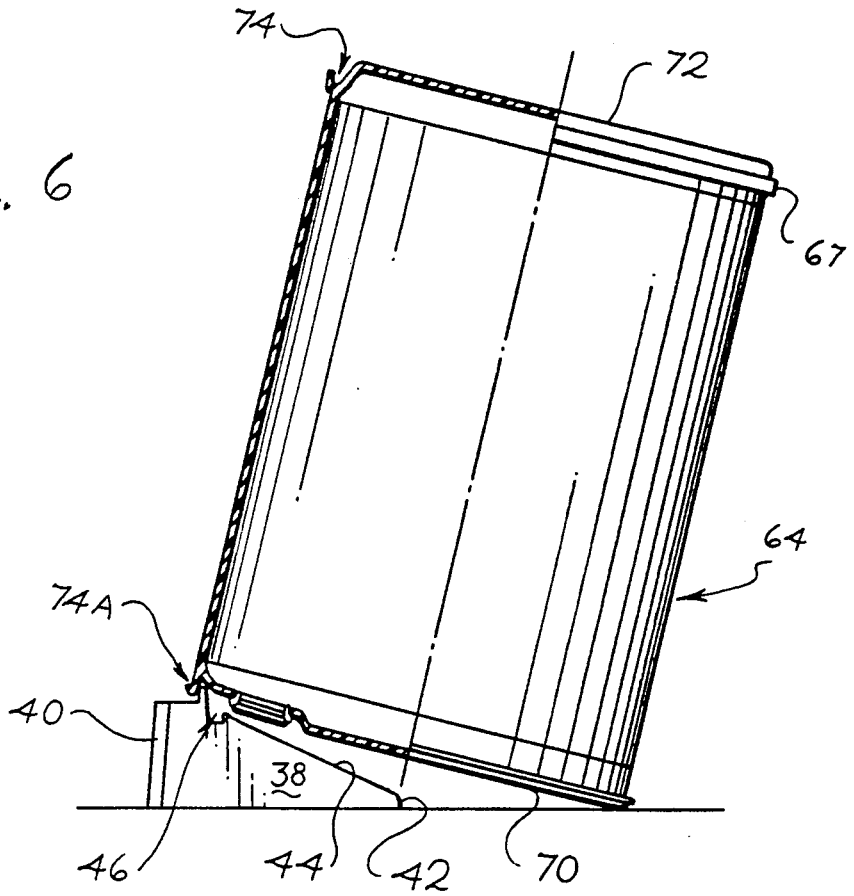
FIG. 6 is a schematic elevational view showing the support device of FIG. 4 in use in a fourth application.

As shown in FIG. 5, the drum may be positioned in an upright tilted position with the ears disposed in the groove of the bottom end wall, when a pump 78 is used to withdraw residual liquid from the drum. In the alternative, the drum may be inverted, such that the ears 76 engage the groove 74 of the lid 70 of the drum as shown in FIG. 6. Alternately, the handling ring 74A may be positioned in channel 46 similarly to a steel drum.

Figure 7:
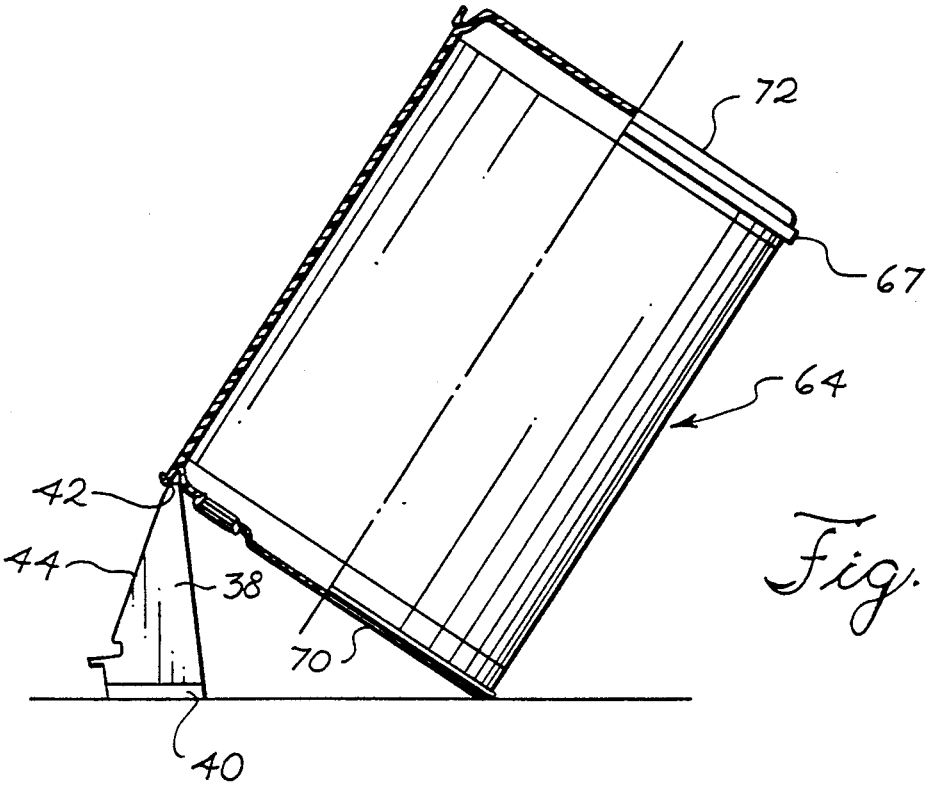
FIG. 7 is a schematic elevational view illustrating the support device of FIG. 4 in use in accordance with a fifth application.

To enable the device to be used in a second orientation providing a greater inclination of the drum, protrusions 80 may be provided on the back wall 40 of the device to enable the device to be stably supported on the back wall. In this configuration, as shown in FIG. 7, the curved front end wall 42 of the device fits into the groove 74 of the end wall of the drum 64. When in this configuration, it may be desirable to employ some further support on the opposite side of the drum to enhance stability, with the device being used principally to gauge the desired angle of tilt. When in this position, the convergence of the sidewalls 38 toward the front end of the device, and the relatively small width of the front end of the device, enhance the stability of the device.

Figure 8:
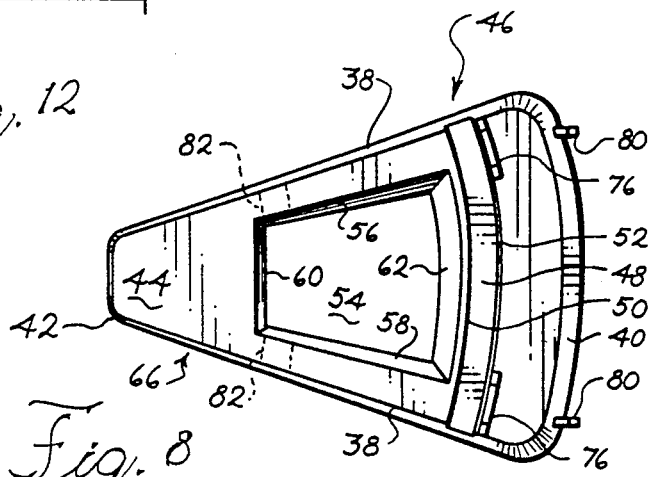
FIG. 8 is a plan view of the support device of FIG. 4.
Figure 10:
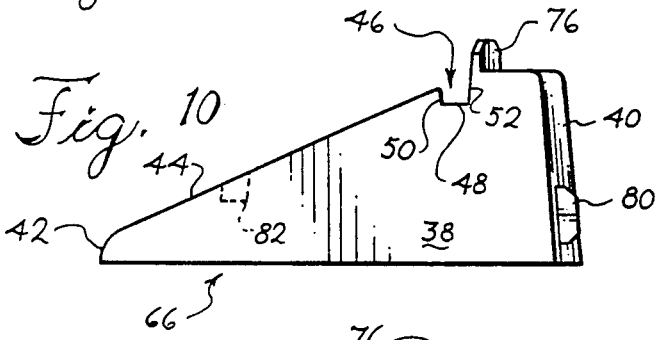
FIG. 10 is a side elevational view of the support device of FIG. 4.
Figure 11:
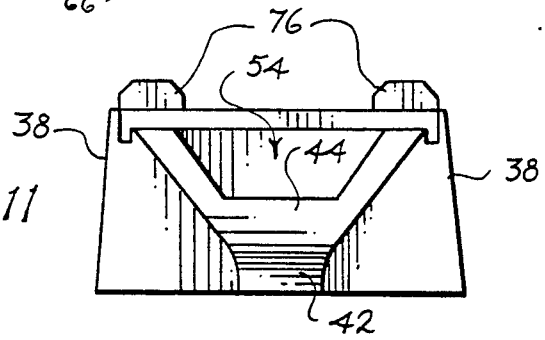
FIG. 11 is a front elevational view of the support device of FIG. 4.
Figure 9:
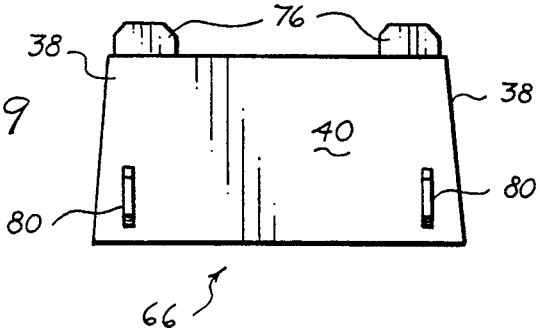
FIG. 9 is a rear view of the support device of FIG. 4.

As shown in FIGS. 8 and 10, the device may also have a pair of slots 82 formed therein forward of the channel 46 to define a second channel for receiving a chime. The second channel may be positioned to support a standard drum at an angle of 5°.

The illustrated device preferably has a length from the front wall to the back wall of about 12 inches, a maximum width of about 8½ inches, and a maximum height of about 5 inches. The bottom of the channel for supporting the drum at a 10° angle is at an elevation of about 4 inches. The channel width is about ¾ to ⅞ of an inch. The opening for receiving the spout has a maximum width of about 5½ inches, and a length from front to back of about 5½ inches. The width of the device across the front wall is about 2 inches. The wall thickness is about ¼-inch.

From the foregoing it should be appreciated that the invention provides a novel and useful device and method for use in removing residue from drum-type containers. The invention is not limited to the embodiment described above, nor to any particular embodiment, but rather is particularly pointed out by the following claims.

What is claimed is:

1. A method of emptying residue from a drum having a generally cylindrical sidewall, a top end wall having first and second spouts projecting upwardly therefrom, and a bottom end wall, said method comprising:
   - inverting said drum;
   - tilting said drum to an inclination of at least about 5° from the vertical;
   - inserting beneath the inverted drum a support device having an upper surface with an opening formed therein configured complementarily to one of said spouts;
   - positioning said support device and said drum so that said first spout is received in said opening and said support device maintains said drum at an inclination of about 5° to 15° from the vertical; and
   - allowing liquid to drain toward the second spout for a period of time selected according to the viscosity of residual liquid remaining in the drum.

2. A method of emptying residue from a drum having a generally cylindrical sidewall, upper and lower end walls, and upper and lower chimes joining said end walls to said sidewall, said method comprising:
   - positioning a pump intake lance in said drum so that the lower end of said pump intake lance is disposed adjacent the interior periphery of the bottom end wall of said drum at a particular point;
   - tilting the drum so that said particular point is lowermost;
   - inserting beneath the lower chime of said drum at a location substantially diametrically opposed to said lowermost particularly point a support device having an upper surface with an upwardly-opening channel formed therein;
   - positioning said support device and said drum so that said chime is received in said channel and said support device maintains said drum at an inclination of about 5° to 15° from the vertical;
   - allowing liquid to drain toward said lowermost point for a period of time selected according to the viscosity and quantity of residual liquid remaining in the drum; and
   - operating said pump to remove said residual liquid from said drum.

3. A method of emptying residue from a drum having a generally cylindrical sidewall, and upper and lower end walls having peripheral grooves formed therein, said method comprising:
   - inserting into said drum through an opening in said upper end wall a pump intake lance having a lower intake end disposed adjacent the interior periphery of the lower end wall of said drum;
   - tilting the drum such that the lower intake end of said pump intake lance is substantially adjacent the lowermost point of the drum interior;
   - inserting beneath the lower end wall of the drum at a location substantially diametrically opposed to the location of the pump intake lance a support device having an upward projection thereon configured for complementary interengagement with said groove;

positioning said support device and said drum so that said upwardly projecting member is received in said groove and said support device maintains said drum at an inclination of about 5° to 15° from the vertical;

allowing liquid to drain toward the lowermost point for a period of time selected according to the viscosity and quantity of residual liquid remaining in the drum; and operating said pump to remove said residual liquid from said drum.

4. A support device to facilitate emptying of residue from a drum, said support device comprising:

a generally wedge-shaped body comprising a front wall, a back wall, a pair of sidewalls which converge from back to front, and a top wall which slopes generally downward from back to front;

said top wall having at least one upwardly projecting ear thereon for insertion in a peripheral end-wall groove on said drum.

5. A support device in accordance with claim 4 wherein said back wall is configured to stably support said device in an on-end position, in which said back wall serves as a base for said device.

6. A support device in accordance with claim 5 wherein said top wall has a transverse, arcuate channel formed therein adjacent said at least one upwardly projecting ear.

7. A support device in accordance with claim 6 wherein said top wall further has an opening formed therein forward of said channel.

8. A container and a support device for insertion beneath said container to facilitate emptying of residue from the container;

said container having a top and a bottom, and comprising a generally cylindrical sidewall, and an end wall at the bottom of the container;

said end wall including a peripheral chime joining said end wall to said sidewall, said chime having an inner surface, an outer surface, and a bottom surface extending between said inner and outer surfaces;

said support device having a front end for insertion beneath said container and an opposite back end, and having means for engaging said inner and outer surfaces of said chime to facilitate proper placement of the device with respect to the chime, and means for engaging the bottom surface of said chime to maintain the container at an inclination of about 5° to 15°.

9. A container and support device in accordance with claim 8 wherein said support device is generally wedge-shaped, and has a top wall which slopes generally upward from front to back, and wherein said means for engaging said inner, outer and bottom surfaces of said chime comprise a channel formed in said top wall.

10. A container and support device in accordance with claim 9 wherein said end wall of said container has a pair of diametrically opposed spouts adjacent the periphery thereof, and wherein said top wall of said device has an opening therein for receiving one of said spouts.

11. A container and support device in accordance with claim 10 wherein said channel comprises a bottom wall and front and back walls extending upward from the bottom wall, and wherein said back wall has a greater vertical dimension than said front wall.

12. A container and support device in accordance with claim 11 wherein the dimensions of said container and said support device are related such that when said chime is disposed in said channel, said container is inclined at an angle of about 10° from the vertical.

13. A container and support device in accordance with claim 12 further comprising a second channel formed in said top wall for receiving said chime to support said container at an inclination of about 5°.

14. A support device to facilitate emptying of residue from a drum, said support device comprising:

a generally wedge-shaped body comprising a front wall, a back wall, a pair of sidewalls which converge from back to front, and a top wall which slopes generally downward from back to front;

said top wall having a curved channel formed therein extending from one sidewall to the other, and having an opening formed therein forward of said channel.

15. A support device in accordance with claim 14 wherein said top wall has a second curved channel formed therein extending from one sidewall to the other.

16. A support device in accordance with claim 15 further comprising at least one upwardly projecting member disposed on said top wall.

* * * * *

UNITED STATES PATENT AND TRADEMARK OFFICE

CERTIFICATE OF CORRECTION

PATENT NO. : 5,238,146

DATED : August 24, 1993

INVENTOR(S) : Thorne, Jr.

It is certified that error appears in the above-identified patent and that said Letters Patent is hereby corrected as shown below:

TITLE PAGE:

[56] References Cited, U.S. PATENT DOCUMENTS, 17th Reference, Under "U.S. Patent No. 4,928,860" change "Thorne, Jr." to --Knight--.

[57] ABSTRACT, line 8, After "front" insert a period.

Column 1, line 15, after "purposes" insert a period.
Column 1, line 20, after "contents" insert a period.
Column 3, line 14, after "section" insert a period.
Column 3, line 34, after "lance" insert --32--.
Column 3, line 37, after "wall" insert --18--.
Column 3, line 49, after "inch" insert --. The vertical dimension from the uppermost portion of the--.
Column 3, line 53, after "device" insert --12--.
Column 4, line 35, after "inward" insert a period.
Column 5, line 17, after "numerals" insert a period.

Signed and Sealed this

Twelfth Day of April, 1994

*Attest:*

Bruce Lehman

BRUCE LEHMAN

*Attesting Officer*

*Commissioner of Patents and Trademarks*